US008115691B2

(12) United States Patent
Takasu

(10) Patent No.: US 8,115,691 B2
(45) Date of Patent: Feb. 14, 2012

(54) ELECTRONIC APPARATUS AND ANTENNA UNIT

(75) Inventor: Nobuaki Takasu, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 179 days.

(21) Appl. No.: 12/576,817

(22) Filed: Oct. 9, 2009

(65) Prior Publication Data

US 2010/0134362 A1 Jun. 3, 2010

(30) Foreign Application Priority Data

Nov. 28, 2008 (JP) ..... 2008-305125

(51) Int. Cl.
*H01Q 1/24* (2006.01)
*H01Q 7/00* (2006.01)
*H01Q 21/00* (2006.01)

(52) U.S. Cl. ..... 343/702; 343/866; 343/893; 343/728

(58) Field of Classification Search ..... 343/870, 343/725, 729, 726, 728, 866, 893, 700 MS
See application file for complete search history.

(56) References Cited

U.S. PATENT DOCUMENTS 6,927,737 B2 * 8/2005 Inoue ..... 343/727
6,992,634 B2 * 1/2006 Hashidate et al. ..... 343/700 MS
7,253,770 B2 * 8/2007 Yegin et al. ..... 343/700 MS
7,405,700 B2 * 7/2008 Duzdar et al. ..... 343/700 MS
7,405,707 B2 * 7/2008 Murofushi et al. ..... 343/725
2005/0104789 A1 5/2005 Hashidate et al.
2009/0058731 A1 * 3/2009 Geary et al. ..... 343/700 MS

FOREIGN PATENT DOCUMENTS

JP 2001-332930 11/2001
JP 2003-152445 5/2003
JP 2005-051536 2/2005
JP 2007-150827 6/2007
JP 2008-305125 12/2008

OTHER PUBLICATIONS

Japanese Patent Application No. 2008-305125; Notification of Reasons for Rejection; mailed Jun. 8, 2010 (English Translation).
Japanese Patent Application No. 2008-305125; Notification of Reasons for Rejection; mailed Mar. 16, 2010 (English Translation).
Japanese Patent Application No. 2008-305125; Notification of Reasons for Rejection; mailed Dec. 15, 2009 (English Translation).

* cited by examiner

*Primary Examiner* — Jacob Y Choi
*Assistant Examiner* — Amal Patel
(74) *Attorney, Agent, or Firm* — Blakely, Sokoloff, Taylor & Zafman LLP

(57) ABSTRACT

According to one embodiment, an electronic apparatus includes a housing, a first board contained in the housing, a second board contained in the housing on the inner side of the first board, a first antenna part, and a second antenna part. The first antenna part includes a loop antenna provided on the first board, and configured to communicate with a communication module opposed to the loop antenna. The second antenna part includes an element part provided in an area surrounded by the loop antenna, and positioned in the same plane as the loop antenna, and a ground part provided on the second board, and configured to communicate with a communication module opposed to the element part.

16 Claims, 5 Drawing Sheets

ELECTRONIC APPARATUS AND ANTENNA UNIT

CROSS-REFERENCE TO RELATED APPLICATIONS

This application is based upon and claims the benefit of priority from Japanese Patent Application No. 2008-305125, filed Nov. 28, 2008, the entire contents of which are incorporated herein by reference.

BACKGROUND

1. Field

One embodiment of the invention relates to an antenna unit provided with a plurality of antennas, and an electronic apparatus.

2. Description of the Related Art

In Jpn. Pat. Appln. KOKAI Publication No. 2003-152445, a composite antenna provided with first and second antennas is disclosed. The first antenna is a circular polarized loop antenna for GPS, and is provided on a dielectric board. The second antenna is a square patch antenna for ETC, and is provided substantially concentric with the first antenna.

In recent years, an electromagnetic induction type flat-panel antenna for proximity communication represented by, for example, Felice (trade name) or the like is provided. Furthermore, at present, an electric field induction type solid antenna for proximity communication, such as TransferJet (trade name) is being developed.

The present inventor considers mounting of a plurality of different antennas for proximity communication on an electronic apparatus. The present inventor further considers that if communication can be performed by making communication modules which are communication partners close to or in contact with one part of the electronic apparatus, the convenience for the user is enhanced.

However, when two antennas for proximity communication are arranged in layers above and below, the distance between the antenna contained in the housing on the inner side of the housing and the communication module becomes large, and there is the possibility of the antenna performance being lowered.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic apparatus comprises: (i) a housing; (ii) a first board contained in the housing; (iii) a second board contained in the housing on the inner side of the first board; (iv) a first antenna part comprising a loop antenna provided on the first board, and the first antenna part being configured to communicate with a communication module opposed to the loop antenna; and (v) a second antenna part comprising an element part provided in an area surrounded by the loop antenna, and positioned in the same plane as the loop antenna, and a ground part provided on the second board, and the second antenna part being configured to communicate with a communication module opposed to the element part.

In general, according to one embodiment of the invention, an antenna unit comprising: (i) a first board; (ii) a second board arranged parallel with the first board; (iii) a first antenna part comprising a loop antenna provided on the first board, and the first antenna part being configured to communicate with a communication module opposed to the loop antenna; and (iv) a second antenna part comprising an element part provided in an area surrounded by the loop antenna, and positioned in the same plane as the loop antenna, and a ground part provided on the second board, and the second antenna part being configured to communicate with a communication module opposed to the element part.

An embodiment of the present invention will be described below on the basis of a drawing of a portable computer to which the present invention is applied.

First Embodiment

Figure 1:
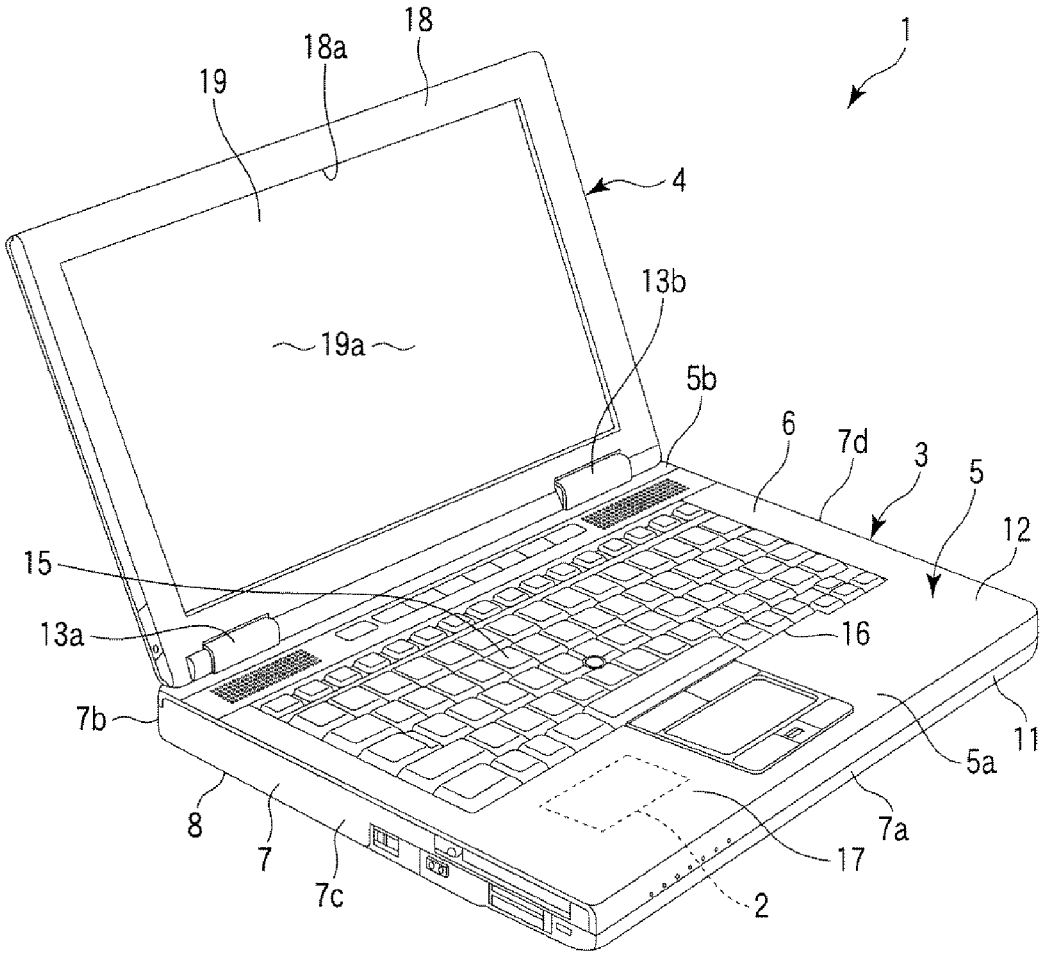
FIG. 1 is an exemplary perspective view of a portable computer according to a first embodiment of the present invention.

FIGS. 1 to 5 disclose a portable computer 1 as an electronic apparatus, and an antenna unit 2 according to a first embodiment of the present invention. As shown in FIG. 1, the portable computer 1 comprises a main unit 3 which is an apparatus main body, and a display unit 4.

The main unit 3 has a main housing 5 formed into a flat box-like shape. The main housing 5 is an example of the housing mentioned in the present invention. The main housing 5 comprises an upper wall 6, peripheral wall 7, and lower wall 8. The upper wall 6 spreads in the substantial horizontal direction. The peripheral wall 7 extends downwardly from the edge part (for example, the edge part of the whole circumference) of the upper wall 6. The lower wall 8 spreads substantially horizontally (i.e., in substantial parallel with the upper wall 6) to connect the lower end parts of the peripheral wall 7 to each other.

The main housing 5 comprises a housing base 11 (i.e., lower cover), and housing cover 12 (i.e., upper cover). The housing base 11 comprises the lower wall 8 and part of the peripheral wall 7. The housing cover 12 comprises the upper wall 6, and part of the peripheral wall 7. The housing cover 12 is combined with the housing base 11 from above.

As shown in FIG. 1, the display unit 4 is supported on the rear end part 5*b* of the main housing 5 by way of, for example, a pair of hinge parts 13*a* and 13*b*. The display unit 4 is rotatable between a closed position, in which the unit 4 is laid down to cover the upper wall 6 of the main housing 5 from above, and an opened position, in which the unit 4 is raised on the upper wall 6.

The main housing 5 comprises a front end part 5*a* on the opposite side of the display unit 4 of the main housing 5. The peripheral wall 7 described above comprises a front wall 7*a*, a back wall 7*b*, and a pair of right and left side walls 7*c* and 7*d*. The front wall 7*a* is positioned at the front end part 5*a* of the main housing 5. The back wall 7*b* is positioned at the rear end part 5*b* (i.e., the end part supporting the display unit 4) of the main housing 5. The left side wall 7*c* and right side wall 7*d* extend at parts between the edge part of the front wall 7*a* and the edge part of the back wall 7*b*.

As shown in FIG. 1, the upper wall 6 comprises a keyboard mounting part 16 on which a keyboard 15 is placed, and supports the keyboard 15. The upper wall 6 comprises a palm rest part 17 on the near side (i.e., on the front wall 7*a* side of the keyboard mounting part 16) of the keyboard mounting part 16.

As shown in FIG. 1, the display unit 4 comprises a display housing 18, and a display panel 19 contained in the display housing 18. The display panel 19 comprises a display screen 19*a*. The display screen 19*a* is exposed to the outside of the display housing 18 through an opening part 18*a* in a front wall of the display housing 18.

As shown in FIG. 1, the portable computer 1 comprises an antenna unit 2 mounted in the main housing 5. The antenna unit 2 is provided at a part, for example, under the palm rest part 17, and is arranged along an inner surface (inside surface) of the upper wall 6.

As shown in FIGS. 2 to 5, the antenna unit 2 comprises first and second boards 21 and 22, first and second antenna parts 23 and 24, and spacers 25.

Figure 4:
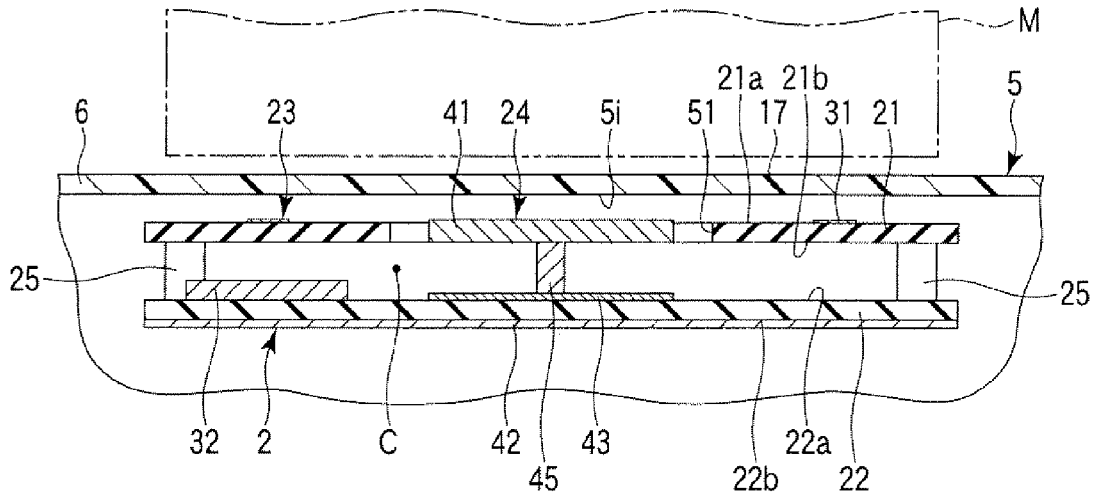
FIG. 4 is an exemplary cross-sectional view showing the antenna unit shown FIG. 2.

As shown in FIG. 4, the first board 21 is contained in the main housing 5. The first board 21 is a so-called loop antenna board (electromagnetic induction antenna board). The first board 21 is opposed to the inner surface 5*i* (e.g., the inner surface of the upper wall 6) of the main housing 5. The first board 21 is positioned closer to the outside of the main housing 5 than the second board 22. The first board 21 comprises a first board surface 21*a* opposed to the inner surface 5*i* of the main housing 5, and a second board surface 21*b* opposed to the second board 22.

As shown in FIGS. 2 to 5, the first antenna part 23 comprises a loop antenna 31. The loop antenna 31 is provided on the first board 21. More specifically, the loop antenna 31 is formed on the first board surface 21*a* of the first board 21, and is opposed to the inner surface 5*i* of the main housing 5. The loop antenna 31 is formed into, for example, an annular shape surrounding a central part of the first board 21.

The first antenna part 23 the loop antenna 31) is an antenna for proximity communication. The first antenna part 23 is, for example, an electromagnetic induction type flat-panel antenna. An example of the first antenna part 23 is an antenna for Felica. As shown in FIG. 4, the first antenna part 23 is configured to communicate with a communication module M opposed to the loop antenna 31 from outside the main housing 5. The communication-enabled distance of the first antenna part 23 is, for example, 3 cm or less.

Figure 3:
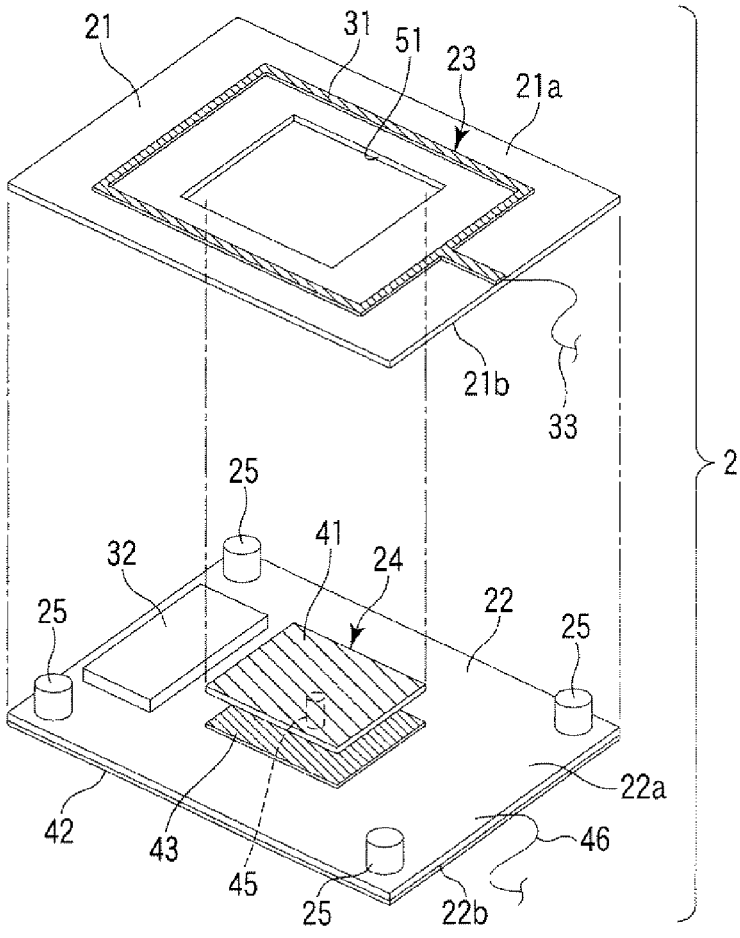
FIG. 3 is an exemplary perspective view showing the antenna unit shown in FIG. 2 in a partly disassembled manner.
Figure 5:
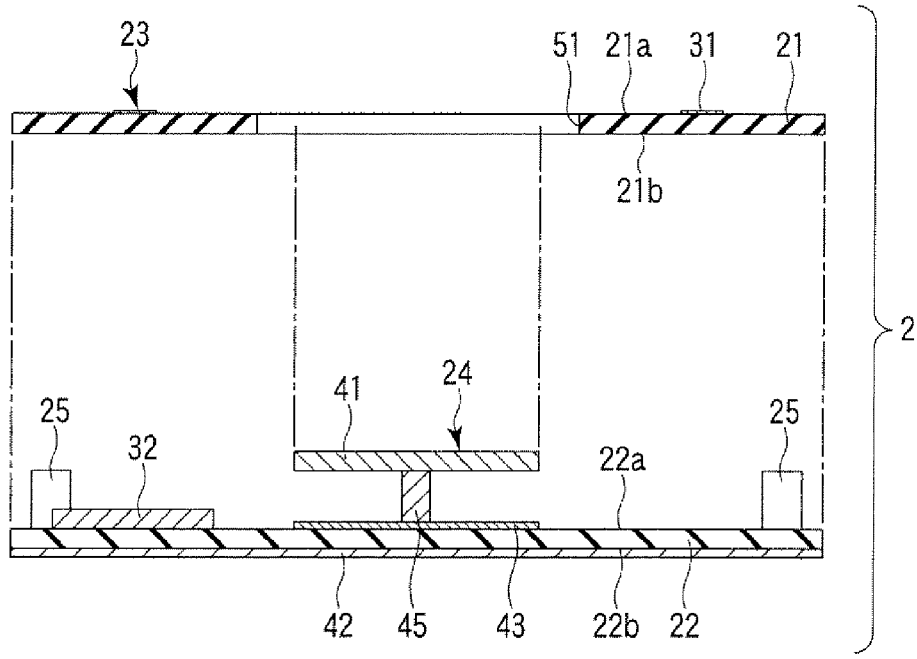
FIG. 5 is an exemplary cross-sectional view showing the antenna unit shown in FIG. 2 in a partly disassembled manner.
Figure 6:
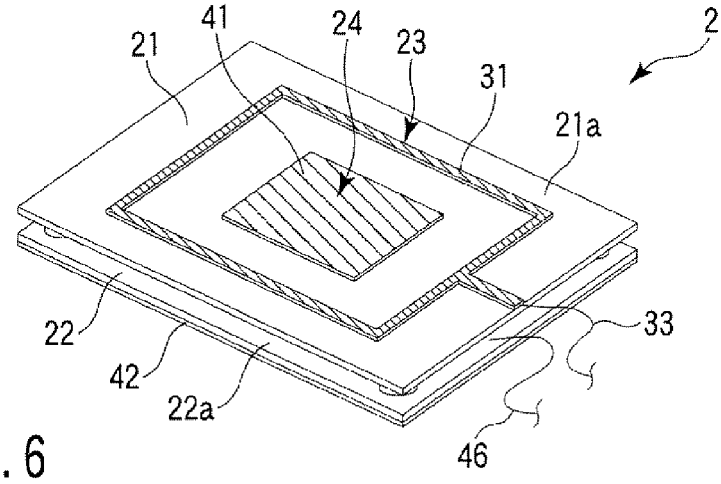
FIG. 6 is an exemplary perspective view of an antenna unit according to a second embodiment of the present invention.

As shown in FIGS. 3 and 5, the first antenna part 23 comprises a transmission and reception circuit part 32. The transmission and reception circuit part 32 is electrically connected to the loop antenna 31 through a first antenna cable 33 and a connector or the like (not shown). The transmission and reception circuit part 32 is mounted on, for example, the second board 22. It should be noted that the transmission and reception circuit part 32 may be provided outside the first and second boards 21 and 22.

As shown in FIG. 4, the second board 22 is contained in the main housing 5 on the inner side of the first board 21. The second board 22 is arranged in parallel with the first board 21 with a gap C held between the second board 22 and the first board 21. The second board 22 is a so-called electric field induction antenna board. The second board 22 comprises a first board surface 22*a* opposed to the first board 21, and a second board surface 22*b* facing the inside of the main housing 5.

As shown in FIGS. 3 and 5, the second antenna part 24 comprises an element part 41, ground part 42, resonance stub 43, and connection part 45. The ground part 42 is provided on the second board surface 22*b* of the second board 22. An example of the ground part 42 is a ground plane arranged on the second board 22. The resonance stub 43 is provided on the first board surface 22*a* of the second board 22. The resonance stub 43 has electrical conductivity.

The element part 41 is a so-called electrode (i.e., coupling electrode), and a gap is held between the element part 41 and the second board 22 (i.e., resonance stub 43). The element part 41 is opposed to the resonance stub 43. The connection part 45 (i.e., a so-called electrode-resonance stub connection leg) is erected between the resonance stub 43 and element part 41. The connection part 45 is interposed between the resonance stub 43 and element part 41, whereby the element part 41 is supported on the second board 22. The connection part 45 has electrical conductivity, and electrically connects the element part 41 to the resonance stub 43.

The second antenna part 24 is an antenna for proximity communication. The second antenna part 24 is, for example, an electric field induction type solid antenna. An example of the second antenna part 24 is an antenna (i.e., a so-called coupler) for TransferJet. As shown in FIG. 4, the second antenna part 24 is configured to communicate with a communication module M opposed to the element part 41 from outside the main housing 5. The communication-enabled distance of the second antenna part 24 is, for example, 3 cm or less. The second antenna part 24 is electrically connected to a transmission and reception circuit (not shown) through a second antenna cable 46.

As shown in FIGS. 3 and 5, the first board 21 comprises an opening part 51 in an area (e.g., a central part of the first board 21) surrounded by the loop antenna 31. That is, the opening part 51 is provided in an area opposed to the element part 41 of the second antenna part 24. The opening part 51 is formed one size larger than the outer shape of the element part 41.

Figure 2:
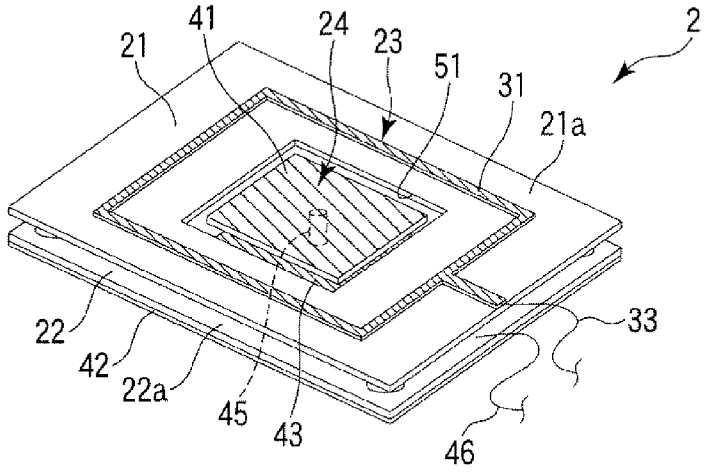
FIG. 2 is an exemplary perspective view of an antenna unit according to the first embodiment of the present invention.

As shown in FIGS. 2 and 4, the second board 22 is laid on the first board 21 with a gap C held between them. The element part 41 is inserted in the opening part 51 of the first board 21, and is contained in the opening part 51. As a result of this, the element part 41 is provided in the area surrounded by the loop antenna 31, and is positioned flush with the loop antenna 31. That is, the flat-panel antenna for proximity communication using the electromagnetic induction system, and the solid antenna for proximity communication using the electric field induction system are mounted on a part at the same position and in the same plane.

As shown in FIG. 4, spacers 25 are interposed between the first and second boards 21 and 22. A height of the first board 21 (i.e., the gap C between the first and second boards 21 and 22) above the second board 22 is adjusted by means of the spacers 25. As the spacers 25, those having a height that position the loop antenna 31 and the element part 41 in the same plane are employed.

Next, the function of the portable computer 1 will be described below.

By making the communication module M, which the partner of communication in the electromagnetic induction system, close to or in contact with the palm rest part 17 at which the antenna unit 2 is arranged, the user can perform communication using the electromagnetic induction system. Further, by making the communication module M, which is the partner of communication in the electric field induction system, close to or in contact with the palm rest part 17 at which the antenna unit 2 is arranged, the user can perform communication using the electric field induction system.

That is, by making the communication module M, which is the partner of communication in the electromagnetic induction system or the communication module M which is the partner of communication in the electric field induction system close to or in contact with the same part of the portable computer 1, the user can perform proximity communication using the respective communication systems.

Further, the antenna part (e.g., an antenna part for Felica) based on the electromagnetic induction system and the antenna part (e.g., an antenna part for TransferJet) based on the electric field induction system differ from each other in the communication system and communication frequency. Accordingly, by making an electronic apparatus in which both the communication module M which is the partner of communication in the electromagnetic induction system and the communication module M which is the partner of communication in the electric field induction system are incorporated close to a part of the portable computer 1, the user can simultaneously perform proximity communication in the two communication systems.

According to the antenna unit 2 configured as described above, the antenna performance becomes hardly lowered. That is, if it is temporarily assumed that two antennas for proximity communication are arranged in layers above and below, the distance between the antenna contained in the housing 5 on the inner side of the housing 5 and the communication module M which is to communicate with the antenna becomes large, and there is the possibility of the antenna performance being lowered. Furthermore, between the antenna contained in the housing 5 on the inner side of the housing 5 and the communication module M which is to communicate with the antenna, the other antenna is present. When an unnecessary substance is present between an antenna and a communication module, there is the possibility of the antenna performance being lowered.

On the other hand, in the antenna unit 2 according to this embodiment, the element part 41 of the second antenna part 24 is provided in the area of the first antenna part 23 surrounded by the loop antenna 31, and thus the loop antenna 31 and the element part 41 are arranged at the same part. As a result of this, communication is enabled by making the communication module M which is the communication partner in each of the communication systems close to or in contact with the same part of the portable computer 1, and the convenience of the user is improved.

Further, the loop antenna 31 of the first antenna part 23 and the element part 41 of the second antenna part 24 are positioned in the same plane, and hence it is possible to arrange both the loop antenna 31 and the element part 41 at a position in the main housing 5 relatively close to the outside of the main housing 5. Accordingly, the antenna performance of each of the first and second antenna parts 23 and 24 is hardly lowered.

Furthermore, according to the structure of this embodiment, it is possible to arrange two antenna parts different from each other in type at the same position, and in the same plane while maintaining the size of the first board 21 (loop antenna board) as it is, and hence it becomes possible to largely reduce the antenna mounting area.

When the second antenna part 24 comprises the resonance stub 43 provided on the second board 22, and the connection part 45 which is erected between the resonance stub 43 and element part 41, and electrically connects the element part 41 to the resonance stub 43, it is possible to obtain the above-mentioned effect by the antenna unit 2 provided with, for example, the antenna part for TransferJet.

When the first board 21 comprises the opening part 51 in the area surrounded by the loop antenna 31, and the element part 41 is inserted in the opening part 51 to be positioned on the same plane as the loop antenna 31, it is possible to realize the above-mentioned structure by a relatively simple structure.

When the transmission and reception circuit part 32 the first antenna part 23 is mounted on the second board 22, it is possible to mount the transmission and reception circuit part 32 while avoiding the opening part 51 (i.e., the element part 41) without increasing the size (i.e., the size of the loop antenna 31) of the first board 21. This contributes to reduction in the size of the antenna unit 2. When the spacers 25 interposed between the first and second boards 21 and 22 are provided, it is possible to position the loop antenna 31 and element part 41 in the same plane by a relatively simple structure.

Second Embodiment

Next, a portable computer 1 and an antenna unit 2 as an electronic apparatus according to a second embodiment of the present invention will be described below with reference to FIGS. 6 to 9. It should be noted that the configuration comprising a function identical with or similar to that of the first embodiment is denoted by the identical reference symbol, and a description thereof will be omitted. Further, the configurations of the portable computer 1 and the antenna unit 2 other than those described below are identical with the first embodiment.

Figure 7:
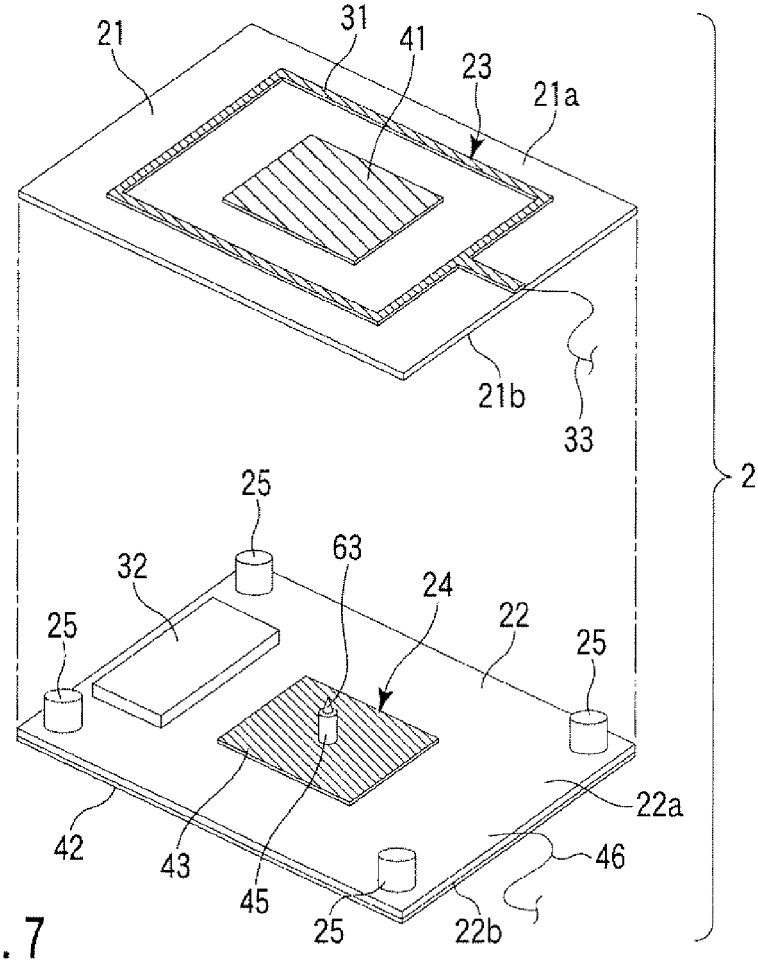
FIG. 7 is an exemplary perspective view showing the antenna unit shown in FIG. 6 in a partly disassembled manner.
Figure 9:
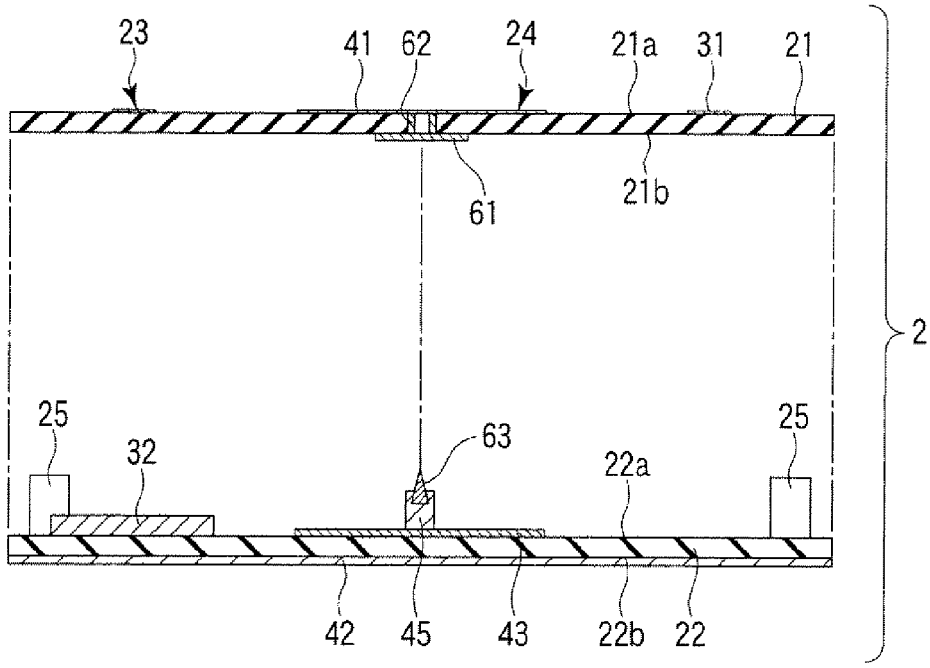
FIG. 9 is an exemplary cross-sectional view showing the antenna unit shown in FIG. 6 in a partly disassembled manner.

As shown in FIGS. 7 and 9, a first board 21 does not comprise an opening part 51. An element part 41 is provided on the first board 21. More specifically, as shown in FIG. 9, the element part 41 is formed on a first board surface 21*a* of the first board 21. The element part 41 is provided in an area (e.g., a central part of the first board 21) surrounded by a loop antenna 31.

As shown in FIG. 9, the first board 21 is provided with a pad 61 and a through-hole 62. The pad 61 and the through-hole 62 are part of a second antenna part 24. The pad 61 is provided on a second board surface 21*b* (board back surface) of the first board 21, and is opposed to a resonance stub 43 of a second board 22 (base board). The through-hole 62 penetrates the first board 21 from the first board surface 21*a* to the second board surface 21*b*. The through-hole 62 electrically connects the element part 41 to the pad 61.

Figure 8:
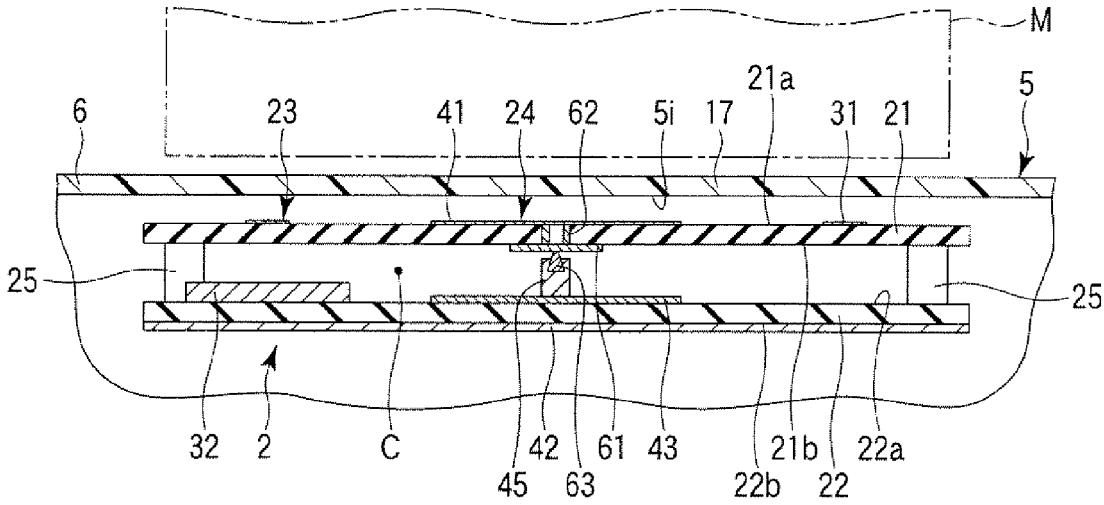
FIG. 8 is an exemplary cross-sectional view showing the antenna unit shown FIG. 6.

As shown in FIG. 9, a connection part 45 comprises a connection pin 63. The connection pin 63 is provided at a distal end part of the connection part 45, and is opposed to the pad 61 of the first board 21. As shown in FIG. 8, in a state where the antenna unit 2 is assembled, the connection pin 63 is brought into contact with the pad 61, whereby the connection part 45 is electrically connected to the pad 61. It should be noted that in place of the connection pin 63, the connection part 45 may be connected to the pad 61 by means of a terminal or other structure.

According to the antenna unit 2 configured as described above, the antenna performance becomes hardly lowered as in the case of the first embodiment. That is, the loop antenna 31 and element part 41 are arranged at the same part, and hence the convenience for the user is improved. Further, the loop antenna 31 of the first antenna part 23 and the element part 41 of the second antenna part 24 are positioned in the same plane, and hence the antenna performance of each of the first and second antenna parts 23 and 24 is hardly lowered.

Furthermore, it is possible to arrange two antenna parts different from each other in type at the same position, and in the same plane while maintaining the size of the first board 21 (loop antenna board) as it is, and hence it becomes possible to largely reduce the antenna mounting area.

The portable computer 1 and antenna unit 2 according to each of the first and second embodiment have been described above. However, the present invention is not limited to the above. Constituent elements according to the respective embodiments may be appropriately combined with each other to be implemented. Furthermore, the constituent elements of the present invention may be modified and embodied in the implementation stage within the scope not deviating from the gist of the invention.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic apparatus comprising:

a housing;

a first board contained in the housing;

a second board contained in the housing on an inner side of the first board;

a first antenna part comprising a loop antenna provided on the first board, the first antenna part being configured to communicate with a communication module opposed to the loop antenna; and a second antenna part comprising an element part provided in an area surrounded by the loop antenna, and positioned in the same plane as the loop antenna, a ground part provided on the second board, a resonance stub provided on the second board, and a connection part standing between the resonance stub and the element part and electrically connecting the element part to the resonance stub, the second antenna part being configured to communicate with a communication module opposed to the element part.

2. The electronic apparatus of claim 1, wherein the first board comprises an opening part in an area surrounded by the loop antenna, and the element part is supported by the second board by way of the connection part, and is inserted in the opening part to be positioned in the same plane as the loop antenna.

3. The electronic apparatus of claim 1, wherein the element part is provided on the first board, the first board comprises a pad opposed to the second board, and a through-hole electrically connecting the element part to the pad, and the connection part is electrically connected to the pad.

4. The electronic apparatus of claim 2, wherein the first antenna part comprises a transmission and reception circuit part electrically connected to the loop antenna, and the transmission and reception circuit part is mounted on the second board.

5. The electronic apparatus of claim 4, further comprising a spacer interposed between the first board and the second board, and positioning the loop antenna and the element part in the same plane.

6. An antenna unit comprising:

a first board;

a second board arranged parallel with the first board;

a first antenna part comprising a loop antenna provided on the first board, the first antenna part being configured to communicate with a communication module opposed to the loop antenna; and a second antenna part comprising an element part provided in an area surrounded by the loop antenna, and positioned in the same plane as the loop antenna, a ground part provided on the second board, a resonance stub provided on the second board, and a connection part standing between the resonance stub and the element part and electrically connecting the element part to the resonance stub, the second antenna part being configured to communicate with a communication module opposed to the element part.

7. The antenna unit of claim 6, wherein the first board comprises an opening part in an area surrounded by the loop antenna, and the element part is supported by the second board by way of the connection part, and is inserted in the opening part to be positioned in the same plane as the loop antenna.

8. The antenna unit of claim 6, wherein the element part is provided on the first board, the first board comprises a pad opposed to the second board, and a through-hole electrically connecting the element part to the pad, and the connection part is electrically connected to the pad.

9. An electronic apparatus comprising:

a housing;

a first antenna part contained in the housing and comprising a loop antenna, the first antenna part being configured to communicate with a communication module opposed to the loop antenna;

a second antenna part comprising an element part provided in an area surrounded by the loop antenna, a ground part provided in the housing on an inner side of the element part and opposed to the element part, and a resonance stub positioned between the ground part and the element part, the second antenna part being configured to communicate with a communication module opposed to the element part; and a connection part positioned between the resonance stub and the element part and electrically connecting the element part to the resonance stub.

10. An electronic apparatus comprising:

a housing;

a first board contained in the housing and comprising an opening part;

a second board contained in the housing on an inner side of the first board;

a first antenna part comprising a loop antenna surrounding the opening part of the first board, the first antenna part being configured to communicate with a communication module opposed to the loop antenna; and a second antenna part comprising an element part supported by the second board and positioned at the opening part, a ground part provided on the second board, and a resonance stub positioned between the ground part and the element part, the second antenna part being configured to communicate with a communication module opposed to the element part.

11. The electronic apparatus of claim 10, further comprising a connection part standing between the resonance stub and the element part and electrically connecting the element part to the resonance stub.

12. An electronic apparatus comprising:

a housing;

a first board contained in the housing and comprising an opening part;

a second board contained in the housing on an inner side of the first board;

a first antenna part comprising a loop antenna surrounding the opening part of the first board, the first antenna part being configured to communicate with a communication module opposed to the loop antenna; and a second antenna part comprising an element part supported by the second board by way of a connection part positioned between the element part and the second board, and positioned at the opening part, and a ground part provided on the second board, the second antenna part being configured to communicate with a communication module opposed to the element part.

13. An antenna unit comprising:

a first antenna part comprising a loop antenna, the first antenna part being configured to communicate with a communication module opposed to the loop antenna;

a second antenna part comprising an element part provided in an area surrounded by the loop antenna, and positioned in the same plane as the loop antenna, a ground part opposed to the element part, and a resonance stub positioned between the ground part and the element part, the second antenna part being configured to communicate with a communication module opposed to the element part; and a connection part positioned between the resonance stub and the element part and electrically connecting the element part to the resonance stub.

14. An antenna unit comprising:

a first board comprising an opening part;

a second board arranged parallel with the first board;

a first antenna part comprising a loop antenna surrounding the opening part of the first board, the first antenna part being configured to communicate with a communication module opposed to the loop antenna; and a second antenna part comprising an element part supported by the second board and positioned at the opening part, a ground part provided on the second board, and a resonance stub positioned between the ground part and the element part, the second antenna part being configured to communicate with a communication module opposed to the element part.

15. The antenna unit of claim 14, further comprising a connection part standing between the resonance stub and the element part and electrically connecting the element part to the resonance stub.

16. An antenna unit comprising:

a first board comprising an opening part;

a second board arranged parallel with the first board;

a first antenna part comprising a loop antenna surrounding the opening part of the first board, the first antenna part being configured to communicate with a communication module opposed to the loop antenna; and a second antenna part comprising an element part supported by the second board by way of a connection part positioned between the element part and the second board, and positioned at the opening part, and a ground part provided on the second board, the second antenna part being configured to communicate with a communication module opposed to the element part.

* * * * *